US009663209B2

(12) United States Patent
Smith

(10) Patent No.: US 9,663,209 B2
(45) Date of Patent: May 30, 2017

(54) MULTI-PURPOSE COLLAPSIBLE PERSONAL WATERCRAFT

(71) Applicant: Robin Smith, Moreno Valley, CA (US)

(72) Inventor: Robin Smith, Moreno Valley, CA (US)

( * ) Notice: Subject to any disclaimer, the term of this patent is extended or adjusted under 35 U.S.C. 154(b) by 0 days.

(21) Appl. No.: 14/715,695

(22) Filed: May 19, 2015

(65) Prior Publication Data

US 2016/0339998 A1 Nov. 24, 2016

(51) Int. Cl.

| | |
|---|---|
| ***B63B 7/04*** | (2006.01) |
| ***B63H 20/00*** | (2006.01) |
| ***B63H 16/08*** | (2006.01) |
| ***B63B 7/02*** | (2006.01) |
| ***B63B 35/73*** | (2006.01) |
| ***B63B 35/78*** | (2006.01) |
| *B63B 7/00* | (2006.01) |

(52) U.S. Cl.

CPC ..... *B63H 20/007* (2013.01); *B63B 7/02* (2013.01); *B63B 35/73* (2013.01); *B63B 35/78* (2013.01); *B63H 16/14* (2013.01); *B63B 2007/006* (2013.01); *B63B 2035/738* (2013.01)

(58) Field of Classification Search

CPC ..... B63H 16/12; B63H 16/14; B63H 20/007; B63H 25/06; B63H 25/08; B63H 25/38; B63B 3/26; B63B 3/48; B63B 7/00; B63B 7/02; B63B 7/04; B63B 35/00; B63B 35/73; B63B 35/731; B63B 2003/265; B63B 2003/485

USPC ..... 114/343, 352, 354, 363, 364

See application file for complete search history.

(56) References Cited

U.S. PATENT DOCUMENTS

| | | | | |
|---|---|---|---|---|
| 3,303,520 | A * | 2/1967 | Bachley | B63C 13/00 114/344 |
| 4,337,543 | A * | 7/1982 | Van Ulzen | B63B 1/14 114/123 |
| 5,239,940 | A * | 8/1993 | Griffin | B63B 7/02 114/353 |
| 5,522,339 | A * | 6/1996 | Pelly | B63B 1/12 114/354 |
| 5,617,810 | A * | 4/1997 | Sauerwein | B63B 7/04 114/123 |
| 5,651,706 | A | 7/1997 | Kasper | |
| 6,334,402 | B1 * | 1/2002 | Gilligan | B63B 7/082 114/345 |
| 6,367,405 | B1 | 4/2002 | Smiley | |
| 6,564,735 | B1 * | 5/2003 | Jackson | B63B 35/36 114/353 |

(Continued)

*Primary Examiner* — Daniele V Venne

(74) *Attorney, Agent, or Firm* — The Keys Law Firm PLLC

(57) ABSTRACT

A multi-purpose personal watercraft for deployment in different configurations as desired by a user. The multi-purpose personal watercraft comprises a base frame defining a watercraft base which includes selectively foldable side extensions, a removable aft floor board, and a bow portion, as well as two opposing side floats with which the base frame is selectively integrated. When in place, the opposing side floats defines form the multi-purpose personal watercraft's U shaped hull and enable the selective attachment of a rudder assembly. With respect to propulsion, base frame is configured to enable the selective deployment of pedal propellers, a user's legs, or a trolling motor. A dual steering system enables the control of up to two discrete steering mechanisms from a single position on the watercraft.

1 Claim, 6 Drawing Sheets

(56) References Cited

U.S. PATENT DOCUMENTS

| | | | | |
|---|---|---|---|---|
| 6,988,456 | B1 * | 1/2006 | Schooler | B63B 1/125 114/344 |
| 7,549,902 | B2 | 6/2009 | Jansen | |
| 8,316,788 | B2 | 11/2012 | Willis | |
| 8,656,856 | B1 | 2/2014 | Morrow | |
| 8,757,185 | B1 | 6/2014 | Muzzio | |
| 8,783,205 | B1 | 7/2014 | Kocher | |
| 2012/0238159 | A1 | 9/2012 | Palvoelgyi et al. | |

* cited by examiner

MULTI-PURPOSE COLLAPSIBLE PERSONAL WATERCRAFT

BACKGROUND OF THE INVENTION

Field of the Invention

This invention relates generally to personal watercraft apparatus and, more particularly, to a multi-purpose, collapsible personal watercraft having plural propulsion means and which is suitable for fishing.

Description of the Prior Art

The use and design of conventional personal watercraft apparatus is well known. A problem which still exists, however, is that conventional personal watercraft apparatus are generally a fixed size and optimized for only one thing, speed. A boater who enjoys riding a personal watercraft and also enjoys fishing is often required to have separate boat just for fishing because the personal watercraft is not suited for fishing. Further, even though they are generally smaller than conventional boats, personal watercraft are often no easier to transport that larger fishing boats and/or speed boats. Thus, there remains a need for a multi-purpose personal watercraft that is collapsible when not in use to enable it to more easily stored and transported. It would be helpful if such a multipurpose personal watercraft included multiple configurations employing discrete propulsion mechanisms. It would be additionally desirable for such a multipurpose personal watercraft to include a dual steering system for enabling control of a plurality of propulsion/navigation devices.

The Applicant's invention described herein provides for a multipurpose personal watercraft adapted to provide a easily transported boat structure that can be customized with floats, a rudder and/or propulsion devices. The primary components in Applicant's multi-purpose personal watercraft are a base frame and opposing side floats. When in operation, the multi-purpose personal watercraft enables a user to deploy a single watercraft in various configurations for various purposes. As a result, many of the limitations imposed by prior art structures are removed.

SUMMARY OF THE INVENTION

A multi-purpose personal watercraft for deployment in different configurations as desired by a user. The multi-purpose personal watercraft comprises a base frame defining a watercraft base which includes selectively foldable side extensions, a removable aft floor board, and a bow portion, as well as two opposing side floats with which the base frame is selectively integrated. When in place, the opposing side floats defines form the multi-purpose personal watercraft's U shaped hull and enable the selective attachment of a rudder assembly. With respect to propulsion, base frame is configured to enable the selective deployment of pedal propellers, a user's legs, or a trolling motor. A dual steering system enables the control of up to two discrete steering mechanisms from a single position on the watercraft.

It is an object of this invention to provide a need for a multi-purpose personal watercraft that is collapsible when not in use to enable it to more easily stored and transported.

It is another object of this invention to provide a multi-purpose personal watercraft that includes multiple configurations employing discrete propulsion mechanisms.

It is yet another object of this invention to provide a multipurpose personal watercraft that includes a dual steering system for enabling control of a plurality of propulsion/navigation devices.

These and other objects will be apparent to one of skill in the art.

DETAILED DESCRIPTION OF THE INVENTION

Figure 1:
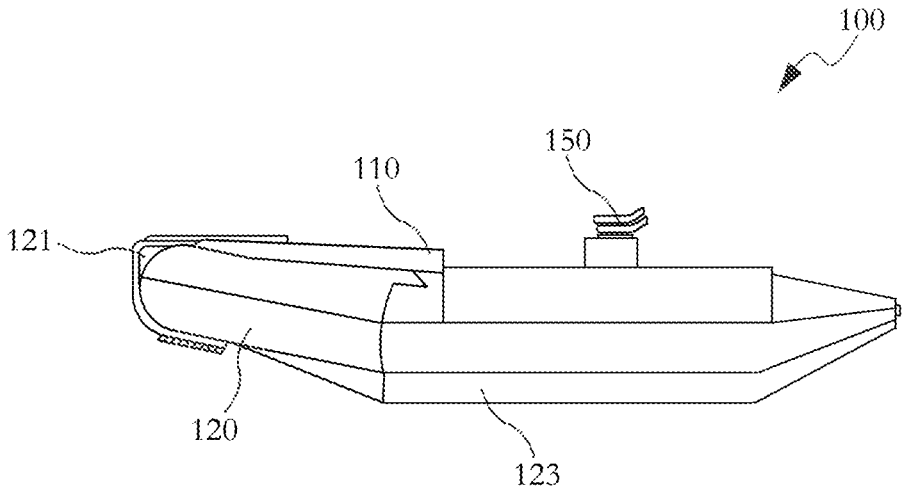
FIG. 1 is a side elevational view of a multi-purpose personal watercraft built in accordance with an embodiment of the present invention in a base assembly.
Figure 2:
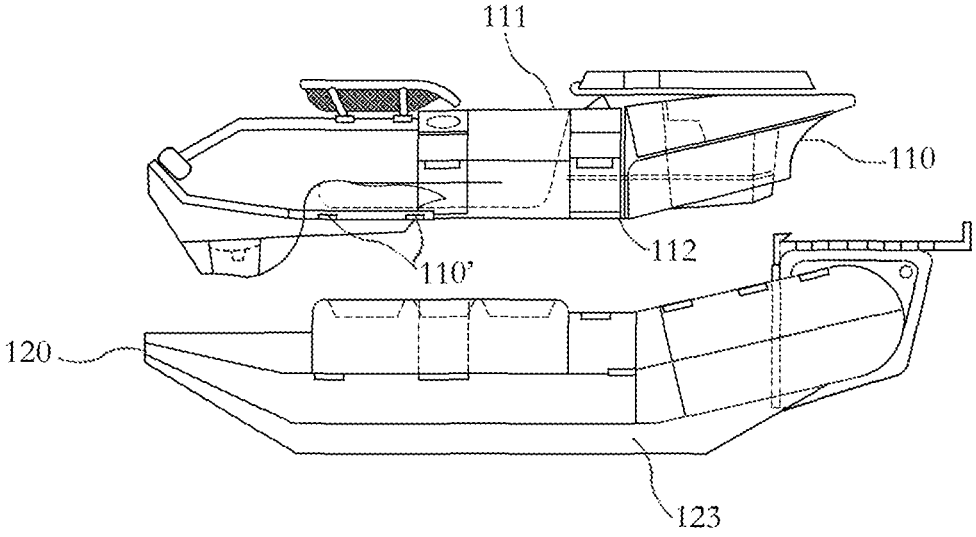
FIG. 2 is an exploded side elevational view of a multi-purpose personal watercraft built in accordance with an embodiment of the present invention.

Referring now to the drawings and in particular FIGS. 1, 2, 3, 3A, 4, 5, 6, 7, 8, and 9, a multi-purpose personal watercraft 100 is shown having a base frame 110 selectively integrated with two opposing side floats 120. The base frame 110 defines a watercraft base having a deck side 111, hull side 112, selectively foldable side extensions 113 and a removable aft floor board 114. Each of the opposing side floats 120 defines a mirror image curved float body having an attachment plate 121. The respective side floats 120 are each selectively attachable individually, either along the starboard edge of the hull side 112 of the base frame 110 or the port edge of the hull side 112 of the base frame 110, depending on the floats 120. It is contemplated that when the respective side floats 120 are in place on the base frame 110, their respective attachment plates 121 converge with one another and are secured together through the interlock of a plurality of teeth 121' that extend from each respective attachment plate 121. Accordingly, when in use, the side floats 120 form the multi-purpose personal watercraft's 100 U shaped hull.

Advantageously, because the side floats 120 attach individually to the base frame, either may be replaced or repaired as needed, without having to replace both.

In the preferred embodiment, the side floats 120 are secured to the base frame 110 through a plurality of float wells 122 on the top surface of the side floats 120 that each correspond to a flange that extends from the hull side 112 of the base frame 110 and frame wells 110' on the side surface of the base frame that each correspond to a flange 122' that extends from the side floats 120. It is contemplated, however, that in alternate embodiments, the side floats 120 may be secured to the base frame 110 through any conventional attachment device that would allow the side floats 120 to be held in a position flush against the surface of the hull side 112 of the base frame 110.

In one embodiment, each side float 120 includes a float enhancement body 123 sized to run along the length of the side float 120. The float enhancement body 123 is selectively attachable to the bottom of the side float 120 and smoothes the transition between the base frame 110 and the attached side float 120 on the underside of the multi-purpose personal watercraft 100.

In one embodiment, the side floats 120 can be selectively folded in half for storage. In one folding embodiment, the side floats 120 can be folded from four feet in length to two feet in length.

Figure 3:
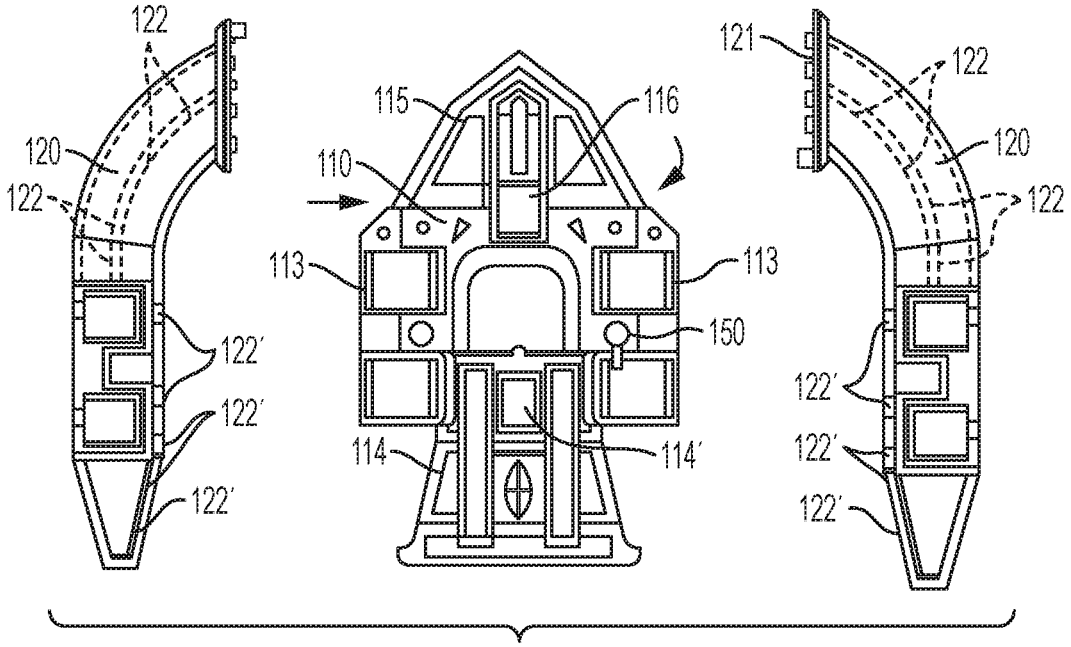
FIG. 3 is an exploded top plan view of a base frame in a deployed configuration and side floats of a multi-purpose personal watercraft built in accordance with an embodiment of the present invention.
Figure 3A:
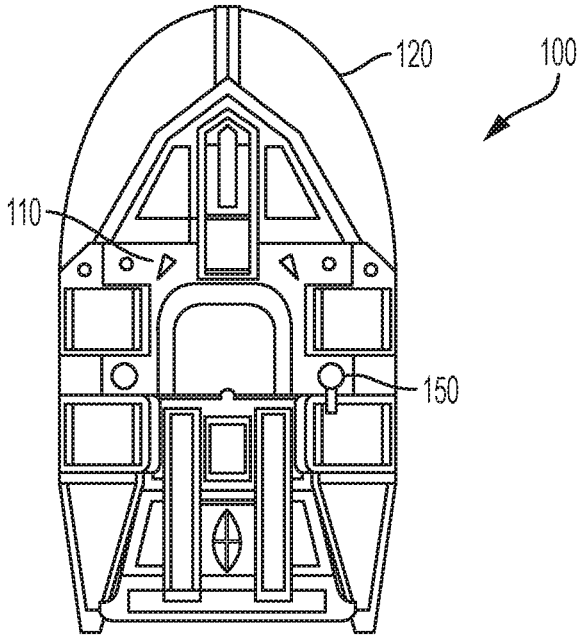
FIG. 3A is a top plan view of a base frame in a deployed configuration and side floats of a multi-purpose personal watercraft built in accordance with an embodiment of the present invention.
Figure 4:
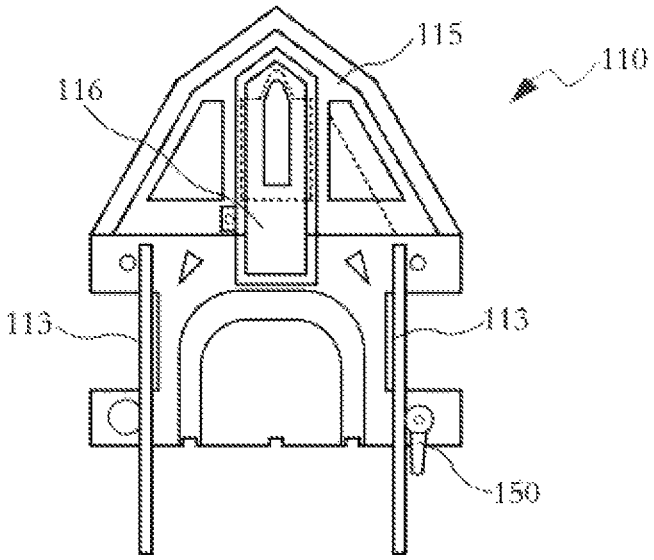
FIG. 4 is a top plan view of a base frame of a multi-purpose personal watercraft built in accordance with the present invention in a storage configuration.
Figure 5:
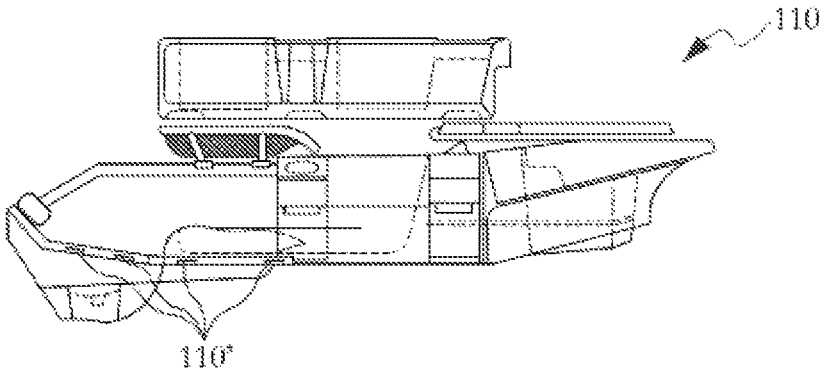
FIG. 5 is a side elevational view of a base frame of a multi-purpose personal watercraft built in accordance with the present invention in a deployed configuration.
Figure 6:
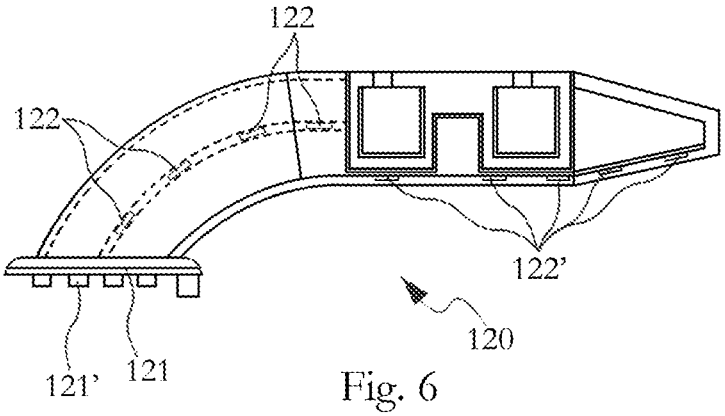
FIG. 6 is a top plan view of a side float of a multi-purpose personal watercraft built in accordance with the present invention in a deployed configuration.
Figure 7:
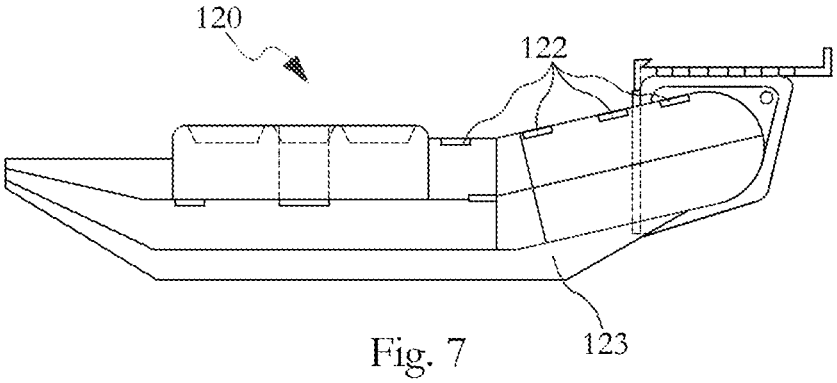
FIG. 7 is a side elevational view of a side float of a multi-purpose personal watercraft built in accordance with the present invention in a deployed configuration.
Figure 8:
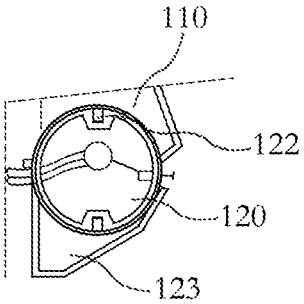
FIG. 8 is a cross section of a front elevational view of a side float of a multi-purpose personal watercraft built in accordance with the present invention in a deployed configuration
Figure 9:
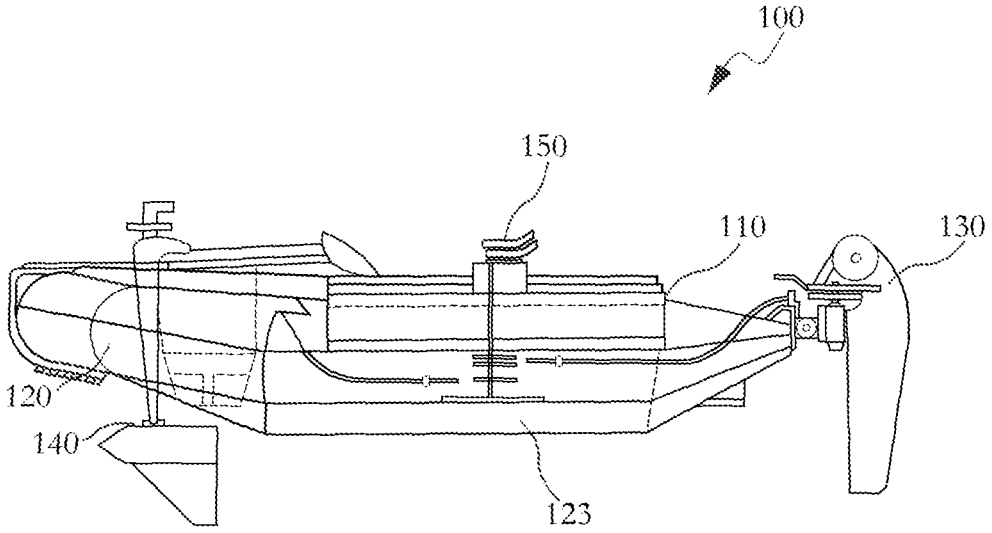
FIG. 9 is a cross section of a side elevational view of a multi-purpose personal watercraft built in accordance with an embodiment of the present invention in a dual steering system.

The foldable side extensions 113 define hingedly attached members that are selectively positionable in a deck position in which they are parallel with the deck of the base frame 110, as shown in FIG. 3, and a storage position in which they are perpendicular with the deck of the base frame 110, as shown in FIG. 4. It is contemplated that in one embodiment, a lockable hinge is employed to attach the foldable side extensions 113 such that they can be locked in their respective positions. It is understood that the positioning of the side extensions 113 allows for the size of the base frame's 110 deck to be maximized while still enabling it to be broken down into a more easily portable and storable size.

The aft floor board 114 is selectively attachable to the base frame 110. In the preferred embodiment, the aft floor board 114 is attachable through a conventional lift Biscuit™ tabs. It is appreciated that when in place, the aft floor board 114 extends the deck of the base frame 110, thereby providing additional space on which to move thereon. On the other hand, by removing the aft floor board 114 (while the side floats 120 are in place and the multi-purpose personal watercraft 100 is in user), a user of the multi-purpose personal watercraft 100 can place their feet or body in the water without fully exiting the boat, whether for leisure or for propulsion. Advantageously, allowing the selective removal of the aft floor board 114, adapts the multi-purpose personal watercraft 100 for easing the entry and exit of the multi-purpose personal watercraft 100 for those with disabilities or who otherwise are uncomfortable entering and exiting over the side of the multi-purpose personal watercraft 100.

Provided the aft floor board 114 is in place, a rudder assembly 130 may additionally be attached to the multi-purpose personal watercraft 100 through a conventional clip fastener. In the preferred embodiment, the rudder assembly 130 attaches to the aft ends of both side floats 120. It is appreciated that by attaching the rudder assembly 130 to both side floats 120, it can be more securely held in place and be centered in the rear of the multi-purpose personal watercraft 100. In the preferred embodiment, the rudder assembly employs a pulley system for control, thereby enabling more efficient control thereof.

The aft floor board 114 additionally includes a drive well slot 114' that is sized to enable the placement and retention of a pedal driven propeller assembly (not shown).

The base frame 110 additionally includes a bow portion 115 that includes a motor well 116 is sized and shaped to receive and hold a conventional trolling motor 140.

The multi-purpose personal watercraft 100 includes an integrated dual steering system 150 that may be used to control steering through an attached rudder assembly 130 and/or an attached trolling motor 140 (collectively, a "steering device"). In the preferred embodiment, the dual steering system 150 includes two discrete handles, each which may be connected to a single navigation and/or propulsion device.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A multi-purpose personal watercraft, comprising:

a base frame defining a watercraft base having a deck side, a hull side, a bow portion, and a removable aft floor board; and two mirror image side floats secured to the hull side of said base frame and to each other, wherein each of said mirror image side floats are curved such that one of the mirror image side floats extends along a starboard side of the watercraft base and contours around the bow portion and the other of the mirror image side floats extends along a port side of the watercraft base and contours around the bow portion.

* * * * *